US010578298B2

(12) United States Patent
Knight

(10) Patent No.: US 10,578,298 B2
(45) Date of Patent: Mar. 3, 2020

(54) LIGHTING MAT

(71) Applicant: Ratu Knight, Kensington (AU)

(72) Inventor: Ratu Knight, Kensington (AU)

( * ) Notice: Subject to any disclaimer, the term of this patent is extended or adjusted under 35 U.S.C. 154(b) by 0 days.

(21) Appl. No.: 15/507,690

(22) PCT Filed: Aug. 28, 2015

(86) PCT No.: PCT/AU2015/050502

§ 371 (c)(1),
(2) Date: Feb. 28, 2017

(87) PCT Pub. No.: WO2016/029271

PCT Pub. Date: Mar. 3, 2016

(65) Prior Publication Data

US 2017/0284654 A1 Oct. 5, 2017

(30) Foreign Application Priority Data

Aug. 29, 2014 (AU) ..... 2014903432

(51) Int. Cl.

| | |
|---|---|
| ***F21V 33/00*** | (2006.01) |
| ***B25H 5/00*** | (2006.01) |
| ***F21V 31/04*** | (2006.01) |
| ***F21Y 105/10*** | (2016.01) |
| ***F21Y 115/10*** | (2016.01) |

(52) U.S. Cl.

CPC ..... *F21V 33/00* (2013.01); *B25H 5/00* (2013.01); *F21V 31/04* (2013.01); *F21Y 2105/10* (2016.08); *F21Y 2115/10* (2016.08)

(58) Field of Classification Search

CPC ..... B25H 5/00; B60Q 2500/10; B60Q 3/20; B60Q 3/54; B60Q 3/745; B60Q 3/46; B60Q 3/47; B60Q 3/51; B60Q 3/53; B60Q 3/80; B60Q 3/88; E04F 2290/026; F21S 4/22; F21S 8/032; F21V 33/00; F21V 31/04; F21V 23/0442; F21V 23/0471; F21V 23/0485; F21Y 2103/10; F21Y 2105/10; F21Y 2115/10

See application file for complete search history.

(56) References Cited

U.S. PATENT DOCUMENTS 4,512,044 A * 4/1985 Clark ..... A47K 3/002 4/581
4,908,887 A * 3/1990 Shaw, Jr. ..... A47C 27/001 5/419
5,019,950 A * 5/1991 Johnson ..... A47G 27/0243 200/85 R
5,848,830 A * 12/1998 Castle ..... A47G 27/0243 362/253
6,220,205 B1 * 4/2001 Massie ..... A01K 1/0157 119/28.5

(Continued)

FOREIGN PATENT DOCUMENTS

WO WO-2006057531 A1 6/2006

OTHER PUBLICATIONS

International Patent Application No. PCT/AU2015/050502, Search Report and Written Opinion dated Sep. 17, 2015, 7 pgs.

*Primary Examiner* — Peggy A Neils
(74) *Attorney, Agent, or Firm* — Schwegman Lundberg & Woessner, P.A.

(57) ABSTRACT

A mat including at least one lighting element, for use in a range of applications including during vehicle maintenance or when camping. The mat typically providing comfort and lighting to a user. The mat also optionally including a range of surface structures to assist with, for example, liquid capture or drainage, and/or dropped item collection.

17 Claims, 5 Drawing Sheets

(56) References Cited

U.S. PATENT DOCUMENTS

| | | | | |
|---|---|---|---|---|
| 6,481,877 | B1 * | 11/2002 | Bello, Jr. | B60N 3/042 362/153 |
| 6,718,576 | B1 * | 4/2004 | Shih | B60N 3/042 362/488 |
| 7,358,861 | B2 * | 4/2008 | Blum | G06Q 30/0241 340/332 |
| 7,456,755 | B2 * | 11/2008 | Blum | A47L 23/22 340/691.6 |
| 7,670,022 | B2 * | 3/2010 | Kessler | A47L 23/266 362/153 |
| 7,670,026 | B1 * | 3/2010 | Hawkins | A47G 27/0212 362/153 |
| 8,033,249 | B1 * | 10/2011 | Cook | A01K 1/0157 119/165 |
| 8,206,002 | B1 * | 6/2012 | Olson | B25H 5/00 280/32.6 |
| 8,353,602 | B2 * | 1/2013 | Van Herpen | B60Q 1/52 362/153 |
| 8,388,184 | B2 * | 3/2013 | Van Herpen | D05C 17/02 174/482 |
| 8,444,287 | B2 * | 5/2013 | Hardesty | E04F 15/02166 15/216 |
| 8,444,294 | B1 * | 5/2013 | Hawkins | A47G 27/0212 362/100 |
| 9,068,720 | B2 * | 6/2015 | Mangus | F21V 15/01 |
| 9,212,814 | B2 * | 12/2015 | Puljan | F21V 33/004 |
| 9,485,839 | B2 * | 11/2016 | Kiser | H05B 37/0227 |
| 2011/0310595 | A1 | 12/2011 | Hardesty | |
| 2014/0142614 | A1 * | 5/2014 | Gallagher | A61H 7/001 606/201 |
| 2014/0369033 | A1 * | 12/2014 | Palfreyman | F21V 21/14 362/183 |

* cited by examiner

LIGHTING MAT

CLAIM OF PRIORITY

This application is a U.S. National Stage Filing under 35 U.S.C. 371 from International Application No. PCT/AU2015/050502, filed on Aug. 28, 2015, and published as WO 2016/029271 A1 on Mar. 3, 2016, which claims the benefit of priority to Australia Patent Application No. 2014903432, filed on Aug. 29, 2014, each of which is hereby incorporated by reference herein in its entirety.

FIELD OF THE INVENTION

The present invention relates to mats, like floor mats or the like, and in particular to mats that provide lighting.

BACKGROUND OF THE INVENTION

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Often when performing maintenance on vehicles, it is necessary to sit or lie on the ground to get a better view of the vehicle and/or to more readily obtain access to the underside of the vehicle. Workshop floors are typically made of concrete and are hard, and therefore can be very uncomfortable for the individual performing the maintenance. The floor may also be dirty from oil, grease, dust, chemicals and/or other particulate material, and therefore, a mechanic/technician lying or sitting directly on the workshop floor may dirty their clothes or come into contact with materials that may be hazardous to their health.

Performing maintenance on vehicles can also be challenging due to the shadow cast by the vehicle. Apart from making it difficult to see the undercarriage of the vehicle, the absence of light beneath a vehicle makes it difficult to locate dropped tools or parts, such as, for example, small bolts.

In the past, when performing maintenance on vehicles, mechanics have typically used creepers. Creepers are skateboard like devices that permit the mechanic to slide beneath the vehicle. However, creeper devices do not effectively address the abovementioned issues associated with comfort for the technician, and do not provide adequate lighting. Further, the wheels of the creeper may slip in puddles of oil and/or may bump into tools or other parts lying on the ground. Creepers are also difficult to store and transport due to their rigid chassis.

SUMMARY OF THE INVENTION

In one broad from the present invention provides a mat including at least one lighting element.

In one form, the mat includes a first surface substantially opposite a second surface.

In one form, the at least one lighting element is embedded within the mat.

In one form, at least one of the surfaces includes at least one depression.

In a further form, at least one of the surfaces includes at least one elevation.

In another form, the mat is substantially flexible so as to permit movement between a compact configuration, wherein the mat is rolled up or folded, and an expanded configuration.

In one form, the mat is formed of a substantially flexible material.

In another form, the mat includes a plurality of lighting elements.

In one form, the mat includes a reflective layer.

In another form, a reflective layer lies between one of the surfaces and the lighting element(s).

In a further form, at least one of the surfaces is ribbed.

In one form, at least one of the surfaces includes at least one channel.

In another form, the at least one channel includes an end at an edge of the mat such that any fluid within the channel is directed toward the edge of the mat.

In a further form, the mat includes at least one penetrating hole therethrough.

In one form, the mat further includes at least one pressure sensor.

In another form, the at least one pressure sensor and lighting element(s) are configured such that on activation of the at least one pressure sensor one or more of the lighting elements are activated or deactivated.

In one form, the at least one elevation is substantially hemispherical.

In another form, the mat is at least partially formed of a translucent material.

BRIEF DESCRIPTION OF THE DRAWINGS

This invention may be better understood with reference to the figures of the embodiments of the invention in which.

DETAILED DESCRIPTION

Figure 1A:
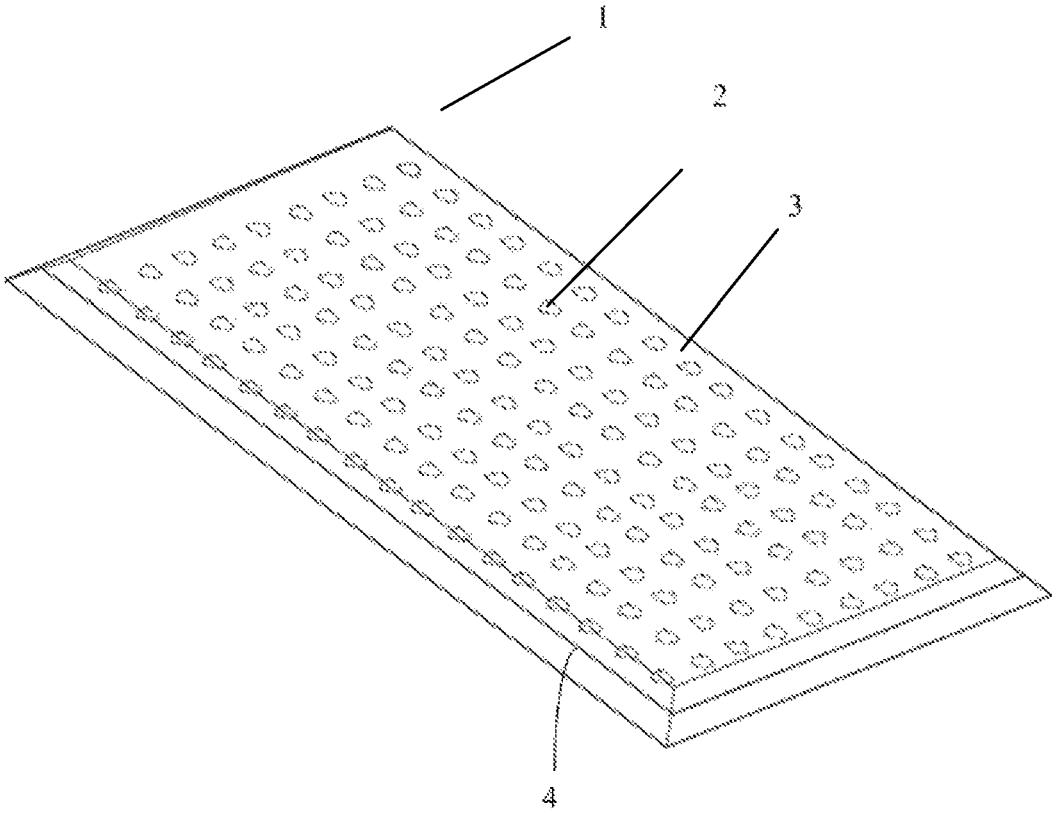
FIG. 1 shows one example of a mat according to one form.
FIG. 1*b* shows a side view of the mat in FIG. 1.

Embodiments of the present invention provide a mat that includes at least one lighting element. In one example application, the mat may be used by mechanics in situations where there is little or low light. For example, the mat may be particularly useful when working beneath a vehicle or when working on a vehicle in the late evening or at night. It will be appreciated that the mat may also have other applications such as, for example, when camping.

Typically the mat includes a plurality of lighting elements embedded within the mat. Having the lighting elements embedded reduces the likelihood of damage to the elements that may occur, for example, when a mechanic lies on the mat or when liquid such as water, oil or coolant drips onto the mat during maintenance. However, it will be appreciated that in some forms the lighting element(s) may not be embedded but fastened or otherwise engaged to a surface of the mat.

The mat typically includes two opposing surfaces or sides. Generally, a top surface, on which a mechanic or other user would lie or sit, and a bottom surface or base, for contact with the ground. The lighting elements are typically embedded in the mat such that light is emitted from at least one of the surfaces. Typically, the mat is configured such that light is emitted from the top surface, however, it will be appreciated that the mat may be configured to be double sided such that light is emitted from both surfaces. To allow light to be emitted, all or part of the mat is typically formed (at least partially) of a translucent, transparent or light permeable material. Forming the mat of a translucent or partially light permeable material, may also contribute to spreading of the light emitted from the lighting elements.

The lighting elements are typically light emitting diodes (LEDs). However, it will be appreciated that other lighting elements may be used. LEDs may be considered advantageous for some forms as they consume relatively low power and do not heat up significantly. In other forms however, the lighting elements may be selected because of their heat providing capability. In addition to providing light, the elements may be used/configured/positioned to provide heat to a user laying on the mat. These forms may be advantageous in times of cold weather and/or when camping for example.

The mat may also include depressions and/or elevations and/or other surface shapes/structures in at least one of the surfaces of the mat. Typically, the elevations and/or depressions and/or other surface shapes/structures are provided in the top or user contacting surface. The depressions/elevations/shapes/structures may provide pits or valleys in the mat capable of collecting fluid such as oil that may have leaked from a vehicle. In addition, the depressions/elevation/shapes/structures can help to prevent items dropped on the mat from rolling away (e.g. tools or bolts etc.). The elevations and/or depressions and/or other shapes/structures may also be configured to contribute to spreading of the light emitted from the lighting elements. It will be appreciated that the surface/s may include a variety of shapes/structures therein, such as, for example, ribs, grooves, channels, hemispherical mounds, pits, a raised perimeter border etc.

It will be appreciated that the mat and lighting elements are typically configured or arranged to provide adequate lighting (for example to the underside of the vehicle), despite either a person or item (e.g. tool) blocking some of the lighting elements. The positioning of the lighting elements within the mat, the angle of the lighting elements in the mat, the material properties of the mat and/or the surface profile/properties of the mat all may (alone or in combination) contribute to the spreading of light emitted from the mat.

The mat is also typically formed of a substantially flexible material, so as to permit movement between a compact configuration, wherein the mat is rolled up or folded, and an expanded configuration, wherein the mat is laid out for use. This permits the mat to be easily stored or easily packed for travel. In one example, the mat is formed at least partly of silicon.

In one example, the mat may include a reflective layer embedded therein. The reflective layer may for example be positioned near to the base or bottom surface beneath the lighting elements so as to reflect light emitted from the lighting elements upwardly through the top surface. Typically, the reflective layer is positioned between the base of the mat and the lighting elements.

The mat is typically formed of a material that is substantially soft (typically flexible yet resilient e.g. rubbery, spongey or the like) to provide comfort to the user. In the case of a mechanic, this may allow the individual to work on the vehicle for longer periods of time, whereas, without the mat, extended periods of contact between the workshop floor and the bony parts of the mechanic may result in pain, discomfort, lack of blood supply and/or numbness to areas of the body. In some forms, the top/user contacting surface profile may be configured to provide a massaging effect to the individual. For example, the mat may include hemispherical elevations/protrusions in the top surface.

The soft nature of the mat and/or surface shape properties may also contribute to the reduction of bouncing of items (e.g. tools, torches or small bolts) dropped on to the mat. This has advantages in that dropped tools are prevented from bouncing away and getting lost under other equipment or becoming damaged from the impact. The mat may also be formed of a material selected so as to reduce noise from the items dropped on the mat.

The mat may also include penetrating holes or apertures that provide passage between opposite surfaces (e.g. top and bottom surfaces) of the mat. The inclusion of such penetrating holes/apertures can aid draining of spilt liquids. The mat may also include internal channels such, such as, for example, leading from an opening in the top surface to an opening in or near to the side edges of the mat. This may help to drain spilt liquid from the top surface, redirecting it away from mat, such that it does note collect on or beneath the mat. This configuration may also protect a user from contacting liquid spilt on the mat, as split fluid may be quickly directed into the internal channels.

The mat may also include one or more pressure sensors. The pressure sensor(s) may function to activate/deactivate all or some of the lighting elements. For example, lighting elements may be in the deactivated state until an individual lays or stands on the mat, at which point, the lighting elements (e.g. via signals from the pressure sensors) activate to provide light. Alternatively, the pressure sensor(s) and lighting elements may be configured such that only the lighting elements surrounding the individual, and not those beneath the individual, light up. Thus, the inclusion of pressure sensor(s) may have significant power saving advantages. It will be appreciated that the pressure sensors and lighting elements may be configured in a variety of ways. In one more complex form, the mat may further include a control unit (e.g. including a microcontroller or other suitable circuity/processing capability) to receive and process signals/information from the sensors and to control the selected activation of the lighting elements.

It will also be appreciated that the mat may be sized/shaped in accordance with its intended purpose. For example, in one form of the mat may be sized to receive the entire body of an individual where as in other forms, the mat may be smaller (e.g. half body size). Smaller forms may be more suitable for travel and may, for example, be included with a spare tyre kit. It will be appreciate the mat may be provide in a range of different shapes, and may for example, be circular, rectangular, triangular, square, oval or other shaped.

In some forms, the mat may also include additional attachments, such as, for example, a hand held torch or power board. For example, a hand held torch may be releasably fastened to the mat for use when closer inspection of the vehicle or workspace is required. An attached/inbuilt power board or sockets may allow an individual to operate or interchange power tools more readily near the work space, and would remove the need for having multiple long extension leads or for a user to get up off the mat, stopping work, to plug/unplug tools.

The mat may be powered by an internal power unit and/or may be connected to main power supply via suitable wired connection with a wall socket. The internal power unit may be configured to receive or may include a rechargeable battery. The power unit may alternatively or additionally be configured to receive disposable batteries.

Particular embodiments of the mat are shown in the accompanying figures.

Figure 1B:
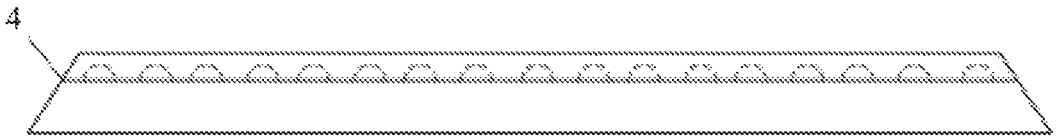

FIG. 1 shows an example of a mat (1) having a plurality of lighting elements (2) embedded therein. The lighting elements (2) are positioned uniformly and are equally spaced. However, it will be appreciated that in other forms the lighting elements (2) may be configured in any pattern such as, for example, along the outskirts of the mat. It will also be appreciated that the elements themselves may be embedded at a range of angles to contribute to spreading of the light. In the example of FIG. 1, the top surface (3) is substantially flat. However, in other embodiments this may not be the case. A reflective layer (4) is also included beneath lighting elements to direct light toward the top surface.

Figure 2A:
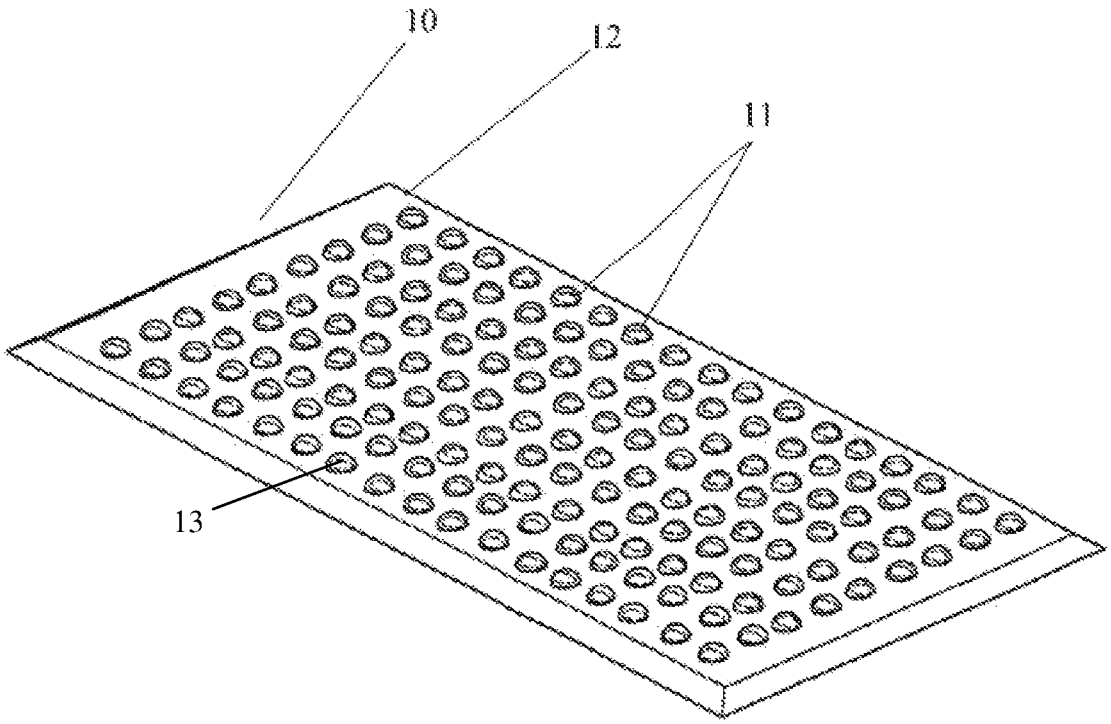
FIG. 2 shows one example of a mat according to one form including hemispherical elevations.
FIG. 2*b* shows a side view of the mat in FIG. 1*b;*
Figure 2B:
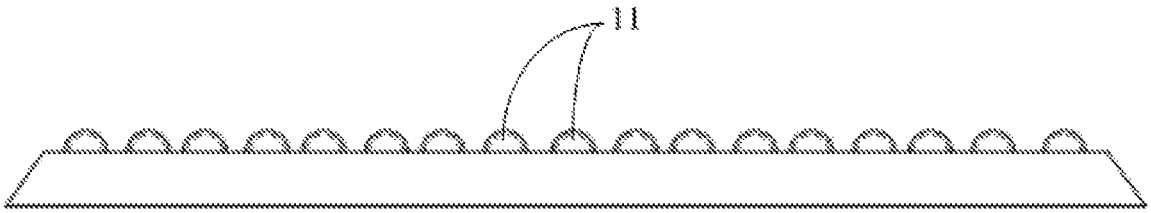

FIG. 2 shows another example of a mat (10). The mat (10) includes a plurality of elevations (11) on the top surface (12). The elevations (11) of the mat (10) are substantially hemispherically shaped, however, it will be appreciated that the elevations may be otherwise shaped. The lighting elements (13) in the mat (10) are shown to be positioned within the elevations (11). In other forms, the lighting elements (13) may be positioned in other portions of the mat (10) such as, for example, between the elevations (11). Apart from contributing to the spread of light emitted from the lighting elements, the hemispherical elevations may also provide a therapeutic massage like effect for a technician or mechanic laying on the mat.

Figure 3A:
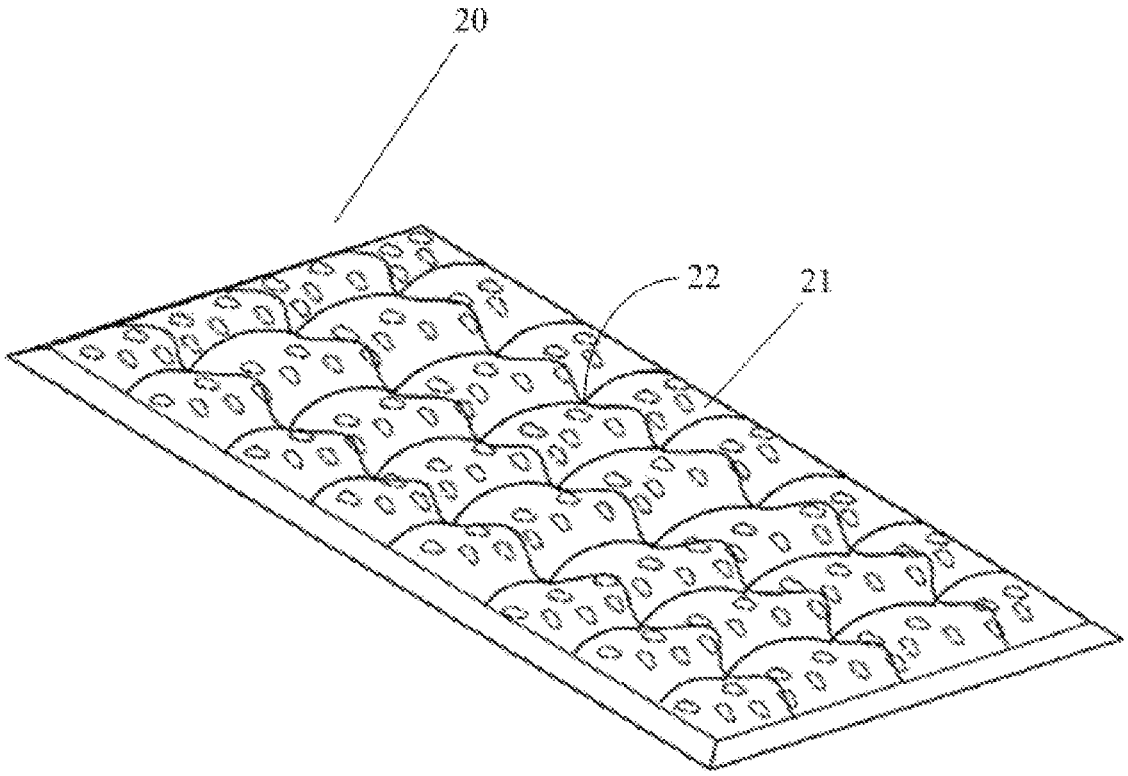
FIG. 3*a* shows a perspective view of an example of a mat according to one form having a surface with pits/depressions therein.
Figure 3B:
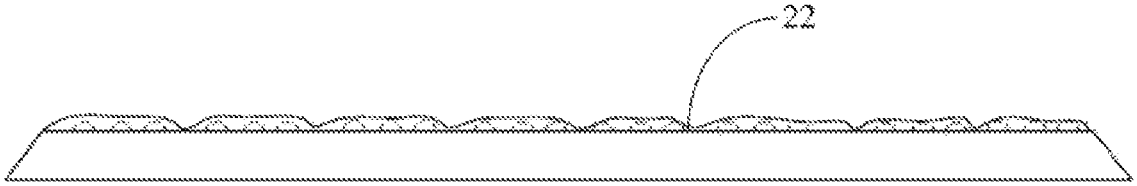
FIG. 3*b* shows a side view of the mat in FIG. 3*a;*

In the embodiment of FIG. 3, the mat (20) has a wave like top surface profile (21) that provides pits (22) that are particularly effective at catching/collecting liquid (e.g. leaking oil or dropped items/tools. The wave like top surface may also contribute to spreading of the light from the light elements, and/or provide additional comfort to the user.

Figure 4A:
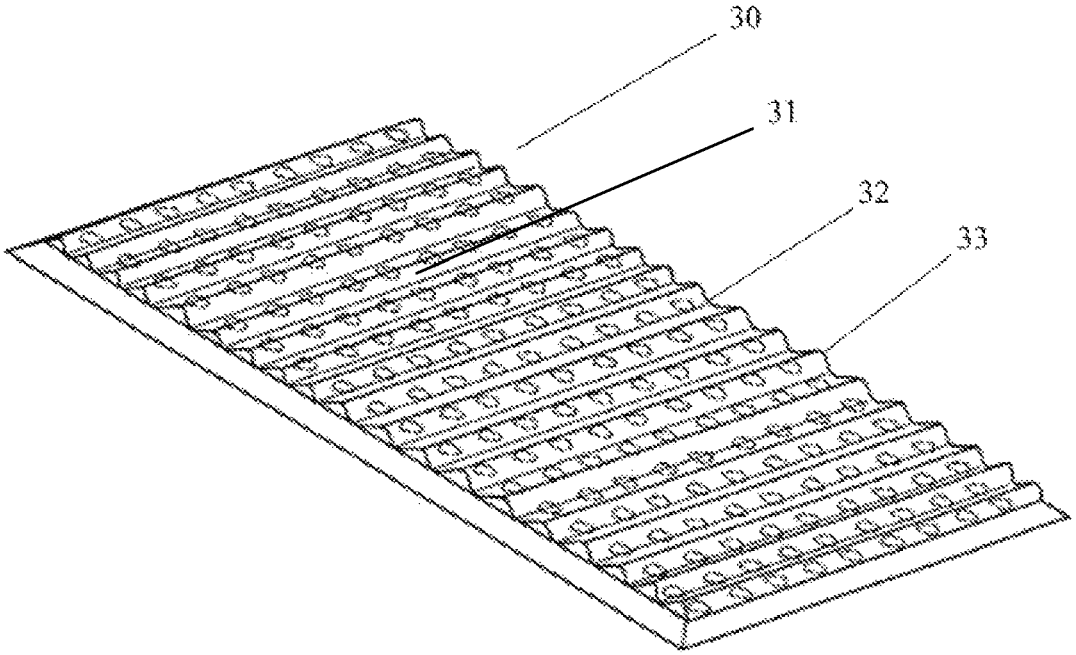
FIG. 4*a* shows a perspective view of an example of a mat according to one form having a ribbed/corrugated surface.
Figure 4B:
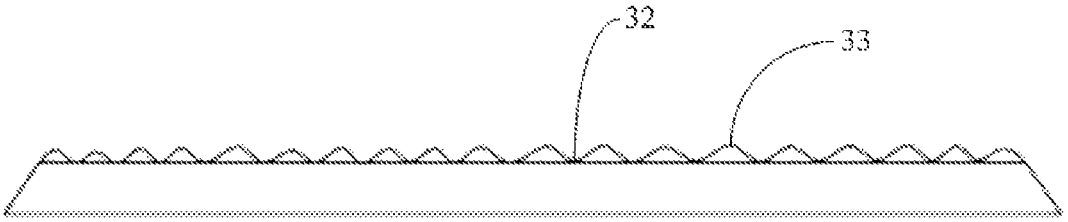
FIG. 4*b* shows a side view of the mat in FIG. 4*a;*

FIGS. 4 and 4*a* show a further embodiment of a mat (30) according to the invention. The mat (30) includes a ribbed/corrugated top surface (31) with a plurality of parallel troughs/channels (32). The ribbed top surface profile is particularly useful for channelling/draining spilt liquid and/or leaking oil along the troughs/channels (32) to the edges of the mat. Further a user/technician laying on the mat (30) may only contact the crests (33) of the corrugations and may therefore be protected from getting substantially wet/dirty from the spilt liquid.

Figure 5A:
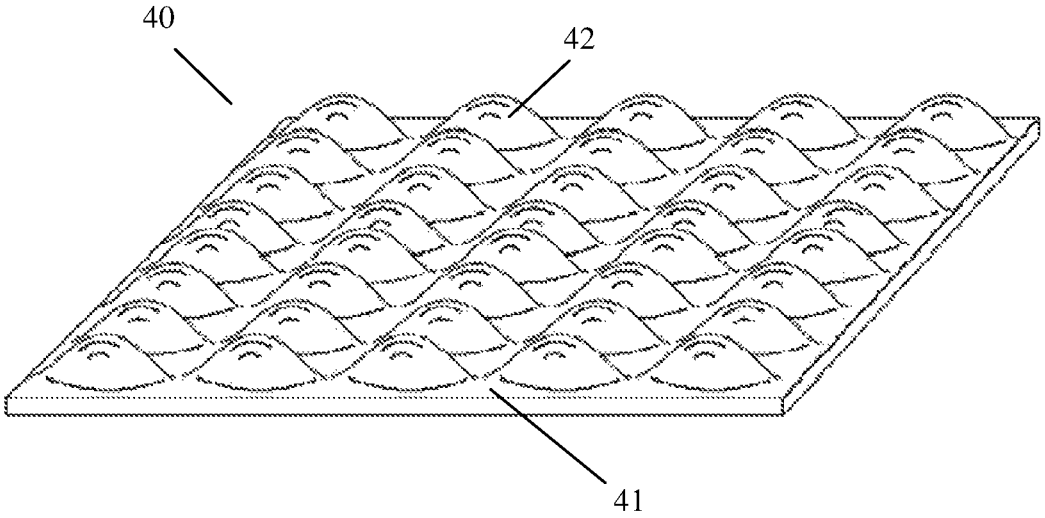
FIG. 5*a* shows a further example of a mat according to one form having a mounded surface.
Figure 5B:
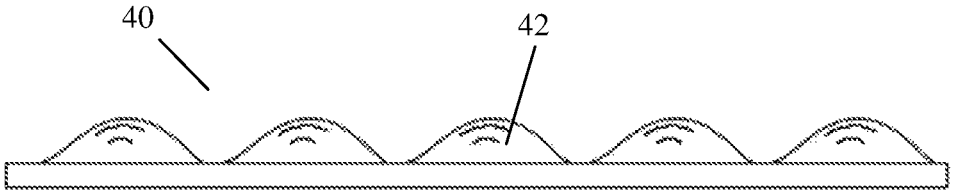
FIG. 5*b* shows a side view of the mat in FIG. 5*a*.

FIG. 5 shows a further embodiment of the mat (40) having a top surface (41) with mound-like elevations (42) which can provide comfort to the user as well as help with trapping of dropped items, tools or parts. The mat (40) in this example is substantially square shaped however it will be appreciated that other forms of the mat may be configured to be any size or shape such as, for example, circular, rectangular, triangular or oval shaped.

It will also be appreciated that a mat may be provided that includes one or more combinations of the top surface features shown in FIGS. 1 to 5 and/or any of the other features as described herein.

It will be appreciated the mat may have range of applications outside the mechanics workshop and outside vehicle maintenance. For example, the mat may be used as a sleeping mat when camping, able to provide comfort, light and/or heat to an individual. The mat may also be used as a doormat, lighting up when guests arrive and step onto the mat.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

Although a preferred embodiment has been described in detail, it should be understood that various changes, substitutions, and alterations can be made by one of ordinary skill in the art without departing from the scope of the present invention.

It will be appreciated that various forms of the invention may be used individually or in combination.

The claims defining the invention are as follows:

1. A mechanic work mat including:

a top surface;

a bottom surface;

at least one lighting element embedded therein, between the top and bottom surfaces so as to be substantially enclosed thereby; and a plurality of solid, non-hollow, mound-like elevations dispersed uniformly across substantially the entire top surface, the mound-like elevations being sized to provide a massage like effect for a mechanic laving thereon and/or to provide an obstacle for items dropped on the mat, so they are discouraged from rolling away, wherein the mechanic work mat is at least partly formed of a light permeable material such that light from the at least one lighting element is emitted from the top surface.

2. A mechanic work mat as claimed in claim 1, wherein the mat is substantially flexible so as to permit movement between a compact stowage configuration and an expanded in-use configuration.

3. A mechanic work mat as claimed in claim 1, wherein the mat includes a plurality of lighting elements dispersed throughout the mat such that light is emitted from substantially the entire top surface thereof.

4. A mechanic work mat as claimed in claim 1, wherein the mat includes a reflective layer.

5. A mechanic work mat as claimed in claim 4, wherein the reflective layer lies between the bottom surface and the lighting element(s).

6. A mechanic work mat as claimed in claim 1, wherein the top surface includes at least one drainage channel.

7. A mechanic work mat as claimed in claim 6, wherein the at least one drainage channel includes an end at an edge of the mat such that any fluid within the drainage channel is directed toward the edge of the mat.

8. A mechanic work mat as claimed in claim 1, wherein the mat includes at least one penetrating hole therethrough.

9. A mechanic work mat as claimed in claim 1, further including at least one pressure sensor.

10. A mechanic work mat as claimed in claim 9, wherein the at least one pressure sensor and lighting element(s) are configured such that on activation of the at least one pressure sensor one or more of the lighting elements are activated or deactivated.

11. A mechanic work mat as claimed in claim 1, wherein the at least one mound-like elevation is substantially hemispherical.

12. A mechanic work mat as claimed in claim 1, wherein the mat is at least partially formed of a translucent material.

13. A mechanic work mat as claimed in claim 1, wherein the compact stowage configuration is either rolled up or folded.

14. A mechanic work mat as claimed in claim 9, wherein the mat includes a plurality of pressure sensors, and is configured such that on activation of a particular pressure sensor, lighting elements proximal to that pressure sensor are deactivated, such that when an object is placed on the mat, the light element(s) beneath that object are deactivated.

15. A mechanic work mat as claimed in claim 1, wherein the bottom surface is substantially flat.

16. A mechanic work mat as claimed in claim 1, wherein the lighting element(s) are embedded in a main portion of the mat and not within the mound-like elevations.

17. A mechanic work mat as claimed in claim 1, wherein the mat is substantially soft so as to provide cushioning/dampening for a mechanic laying thereon and/or dropped items.

* * * * *